US010668933B2

(12) United States Patent
Taylor

(10) Patent No.: US 10,668,933 B2
(45) Date of Patent: Jun. 2, 2020

(54) ACTUATING SYSTEM FOR TRANSVERSE DOORS OF RAILROAD HOPPER CAR

(71) Applicant: Railcar Innovations, LLC, Cleveland, TN (US)

(72) Inventor: Fred J. Taylor, Independence, KY (US)

(73) Assignee: Railcar Innovations, LLC, Cleveland, TN (US)

( * ) Notice: Subject to any disclaimer, the term of this patent is extended or adjusted under 35 U.S.C. 154(b) by 368 days.

(21) Appl. No.: 15/837,084

(22) Filed: Dec. 11, 2017

(65) Prior Publication Data

US 2019/0176852 A1 Jun. 13, 2019

(51) Int. Cl.
*B61D 7/26* (2006.01)
*B61D 7/02* (2006.01)

(52) U.S. Cl.
CPC ..... *B61D 7/26* (2013.01); *B61D 7/02* (2013.01)

(58) Field of Classification Search
CPC ... B61D 7/26; B61D 7/02; B61D 7/00; B61D 7/18; B61D 7/28; B61D 7/20; B60P 1/56; B65D 90/58; B65D 90/587
USPC ..... 105/248, 247, 249, 250, 251, 253, 254, 105/255, 280, 286, 288, 289
See application file for complete search history.

(56) References Cited

U.S. PATENT DOCUMENTS 3,608,500 A * 9/1971 Floehr ..... B61D 7/26 105/240
4,339,222 A * 7/1982 Knippel ..... B61D 7/30 105/241.1
4,628,825 A * 12/1986 Taylor ..... B61D 7/28 105/253
4,766,820 A * 8/1988 Ritter ..... B61D 7/28 105/240
4,829,908 A * 5/1989 Hallam ..... B61D 7/28 105/240
4,843,974 A * 7/1989 Ritter ..... B61D 7/28 105/240
2005/0263032 A1* 12/2005 Taylor ..... B61D 7/28 105/286

(Continued)

*Primary Examiner* — Justin M Jonaitis
(74) *Attorney, Agent, or Firm* — Chambliss, Bahner & Stophel, P.C.

(57) ABSTRACT

A left hopper door and a right hopper door are associated with a hopper of a railroad hopper car that includes an operating beam which is longitudinally moveable within a center sill. A door operating mechanism for such doors includes an operating arm that includes a longitudinal slot, and a fulcrum that is attached to the operating beam. The fulcrum includes a pin that is adapted to slide within the slot of the operating arm. A V-lever is pivotally mounted on the center sill. The V-lever includes a left arm that is attached to the left hopper door and a right arm that is attached to the right hopper door. The right arm of the V-lever also include an intermediate pivot mount to which the operating arm is pivotally attached. An arming assembly is configurable in an armed configuration in which longitudinal movement of the operating beam will cause the left hopper door and the right hopper door to move between opened and closed positions, and in a disarmed configuration in which longitudinal movement of the operating beam will not cause the left hopper door and the right hopper door to move.

9 Claims, 19 Drawing Sheets

(56) References Cited

U.S. PATENT DOCUMENTS

2006/0272541 A1* 12/2006 Taylor ..... B61D 7/24
105/299

* cited by examiner

ACTUATING SYSTEM FOR TRANSVERSE DOORS OF RAILROAD HOPPER CAR

FIELD OF THE INVENTION

The present invention relates generally to a mechanism for operating the transversely oriented doors of a railroad hopper car. More particularly, the invention relates to a mechanism for selectively operating one or any number of the transversely oriented door pairs on a railroad hopper car using a single linear actuator.

BACKGROUND OF THE INVENTION

A railroad hopper car is a type of freight car having a plurality of hoppers that is used to transport loose bulk commodities such as coal, ore, phosphate, grain, and other commodities. Some railroad hopper cars are covered, and others have an open top. Covered hopper cars are used for bulk cargo that must be protected from exposure to the weather, such as grain, sugar and fertilizer. Open hopper cars are used for commodities such as coal, which can suffer exposure with less detrimental effect. Railroad hopper cars may be equipped with one or more opening doors on the underside through which the cargo is discharged. Some such cars are equipped with longitudinally oriented doors, and others are equipped with transversely oriented doors. Railroad hopper cars with transversely oriented doors are usually provided with a pair of doors for each hopper in the car, or with a pair of doors on each side of the center sill for each hopper. The development of railroad hopper cars accompanied the development of automated handling of such commodities, with automated loading and unloading facilities.

Loaded railroad hopper cars are moved into position over an unloading pit, and one or more pairs of doors are opened to discharge the contents of one or more hoppers by gravity into the unloading pit, where a conveyor is typically mounted to carry the cargo away for processing or other use. Several mechanisms are known for operating the doors of a hopper car, including the mechanisms described in my prior U.S. Pat. Nos. 5,249,531, 6,405,658, 6,955,127, 7,080,599 and 7,523,708.

ADVANTAGES OF THE INVENTION

Among the advantages of a preferred embodiment of the invention is that it provides a mechanism for selectively operating one or any number of the transversely oriented door pairs on a railroad hopper car using a single linear actuator. Other advantages and features of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "coupled", "connected" and "interconnected", refer to a relationship wherein structures are secured or attached to one another either directly or indirectly through intervening structures, as well as both moveable and rigid attachments or relationships, unless specified herein or clearly indicated by context. The terms "operatively connected" and "operatively attached" describes such an attachment, coupling or connection that allows the pertinent structures to operate as intended by virtue of that relationship. The term "fluid communication" refers to such an attachment, coupling or connection that allows for flow of fluid from one such structure or component to or by means of the other.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "linear actuator" refers to an electric, pneumatic, hydraulic, electro-hydraulic or mechanical device that generates force which is directed in a straight line. One common example of a "linear actuator" is a pneumatic actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

The terms "upper", "top" and similar terms, when used in reference to a relative position or direction on or with respect to a railroad hopper car, an operating mechanism for the hopper doors of a railroad hopper car, or a component or portion of such an operating mechanism, refer to a relative position or direction that is farther away from the track on which the railroad hopper car is placed for operation.

The terms "lower", "bottom" and similar terms, when used in reference to a relative position or direction on or with respect to a railroad hopper car, an operating mechanism for the hopper doors of a railroad hopper car, or a component or portion of such an operating mechanism, refer to a relative position or direction that is nearer to the track on which the railroad hopper car is placed for operation.

SUMMARY OF THE INVENTION

The invention comprises a mechanism for the selective operation of one or any number of the transverse hopper door pairs of a railroad hopper car using a single linear actuator. In a preferred embodiment of the invention, each door operating mechanism includes a slotted operating arm coupled to each hopper door of the pair associated with the hopper by a V-lever, and to an operating beam by a linkage assembly. The operating beam is coupled to the linear actuator. Each of the preferred door operating mechanisms also has an arming cam that may be rotated between an "armed" position and a "disarmed" position. When the arming cam is rotated to the "armed" position, operation of the linear actuator to apply a linear force to the operating beam will move the slotted operating arm in the same direction as the operating beam, thus rotating the V-lever and opening or closing the doors of the hopper, depending on the direction of the linear force. When the arming cam is rotated to the "disarmed" position, the slotted operating arm is not moved when a linear force is applied to the operating beam, so that the doors associated with the hopper are not opened or closed by the application of the linear force.

In order to facilitate an understanding of the invention, the preferred embodiment of the invention, as well as the best mode known by the inventor for carrying out the invention, are illustrated in the drawings, and a detailed description thereof follows. It is not intended, however, that the invention be limited to the particular embodiment described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and wherein.

DESCRIPTION OF THE PREFERRED EMBODIMENTS OF THE INVENTION

Figure 1:
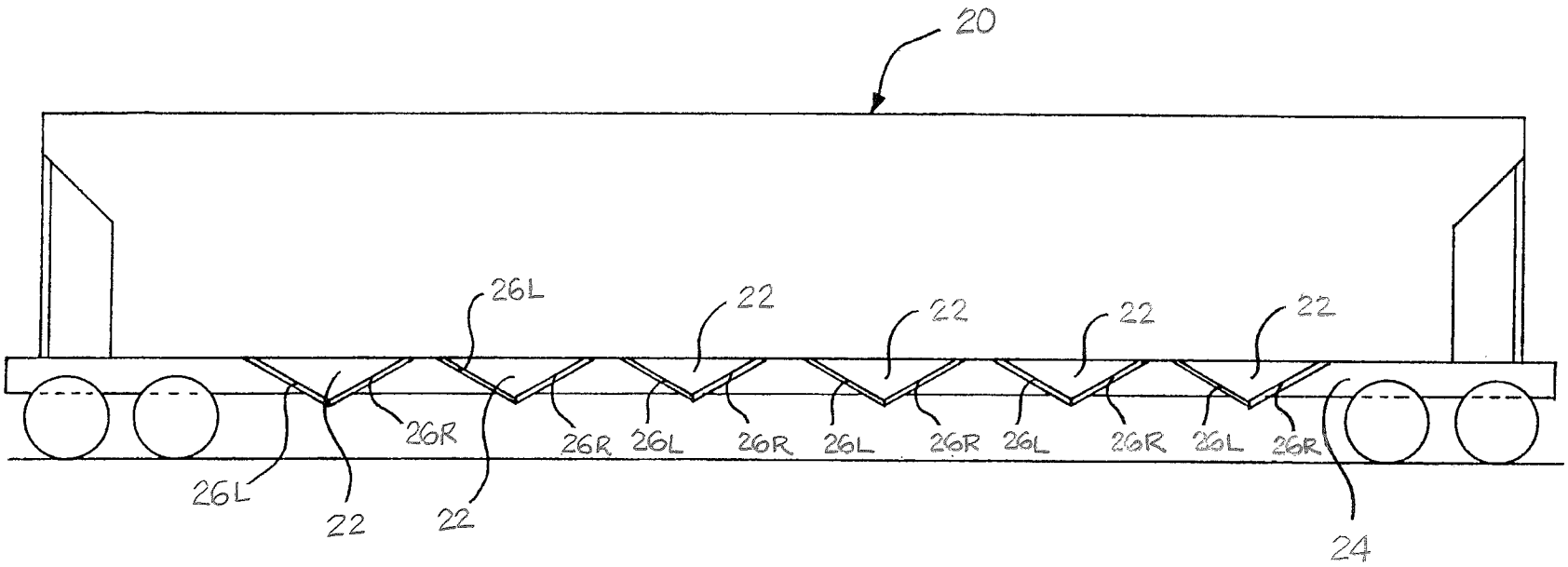
FIG. 1 is a schematic side view of a six-hopper railroad hopper car to which the invention may be applied, showing the doors associated with each of the hoppers in a closed position.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

Figure 2:
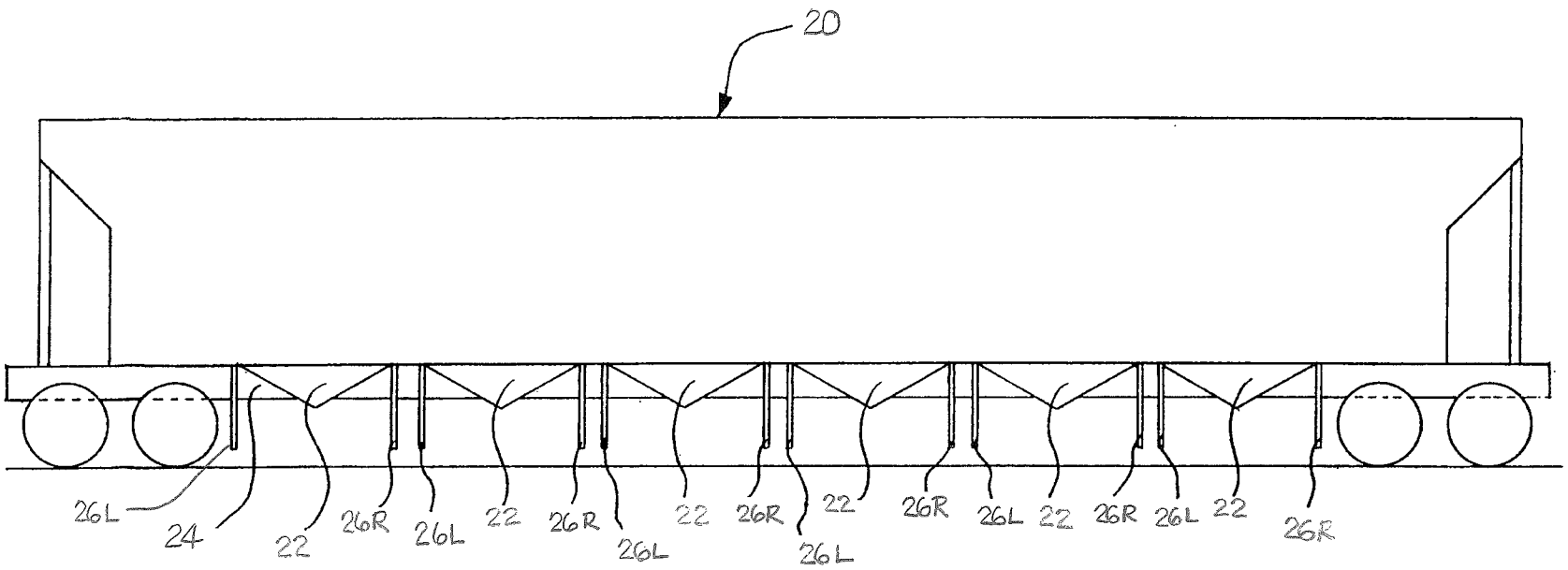
FIG. 2 is a schematic side view of a six-hopper railroad hopper car to which the invention may be applied, showing the doors associated with each of the hoppers in an open position.
Figure 3:
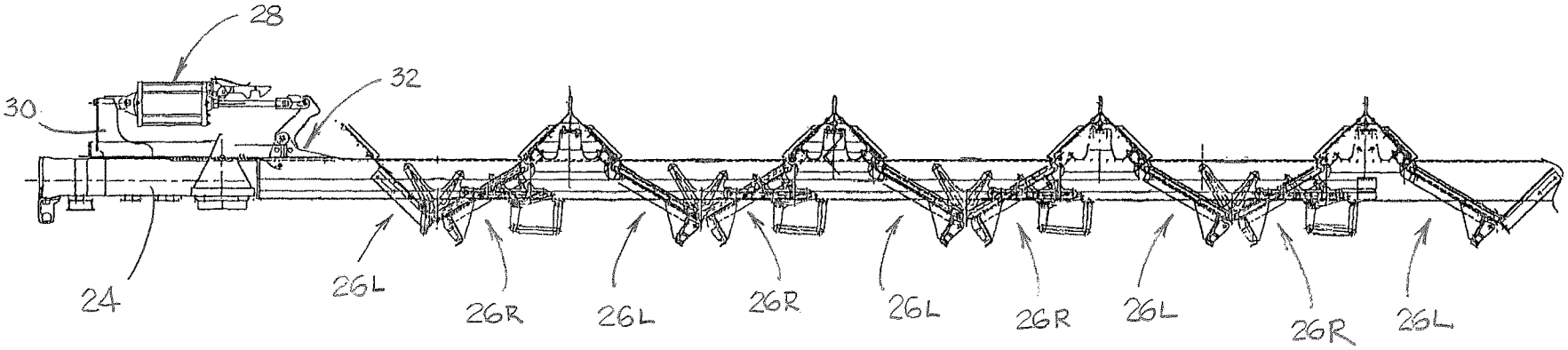
FIG. 3 is a side view of a portion of the hopper car shown in FIGS. 1 and 2, illustrating the components of the door operating mechanism of the invention with respect to a plurality of pairs of doors.

Referring now to the drawings, FIGS. 1-4 illustrate a six-hopper railroad hopper car (or portions thereof) to which the invention may be applied. Railroad hopper car 20 includes six hoppers 22 and a longitudinally extending center sill 24. Each of hoppers 22 is equipped with two opposing door assemblies, each comprising a pair of doors 26L and 26R. In FIGS. 1-3, only one pair of doors 26L and 26R is shown for each hopper; a second identical pair of doors is located on the opposite side of center sill 24.

Figure 4:
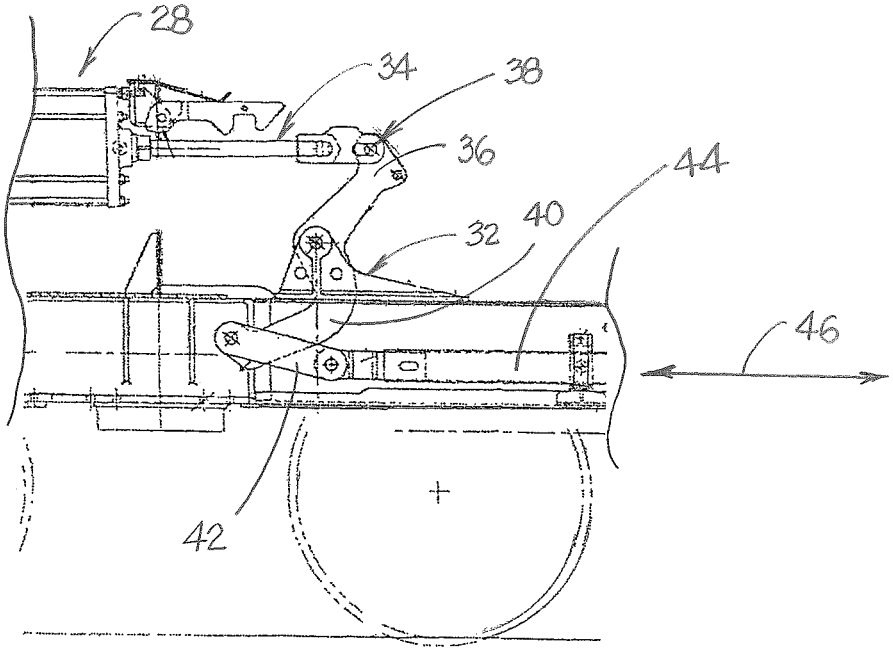
FIG. 4 is an enlarged view of a portion of the components of the door operating mechanism shown in FIG. 3.

A conventional actuating assembly includes linear actuator 28, which is mounted on top of center sill 24, as shown in FIGS. 3 and 4, by left bracket 30 (as viewed in FIG. 3) and right bracket 32. Linear actuator 28 includes rod 34 that is pivotally connected to upper link 36 at upper pivot 38. Upper link 36 is connected to intermediate link 40, and intermediate link 40 is connected to lower link 42 which is connected to operating beam 44 in such a manner that extension and retraction of rod 34 will cause operating beam 44 to move longitudinally back and forth along the long axis of the railroad car, as indicated by arrows 46.

Figure 7:
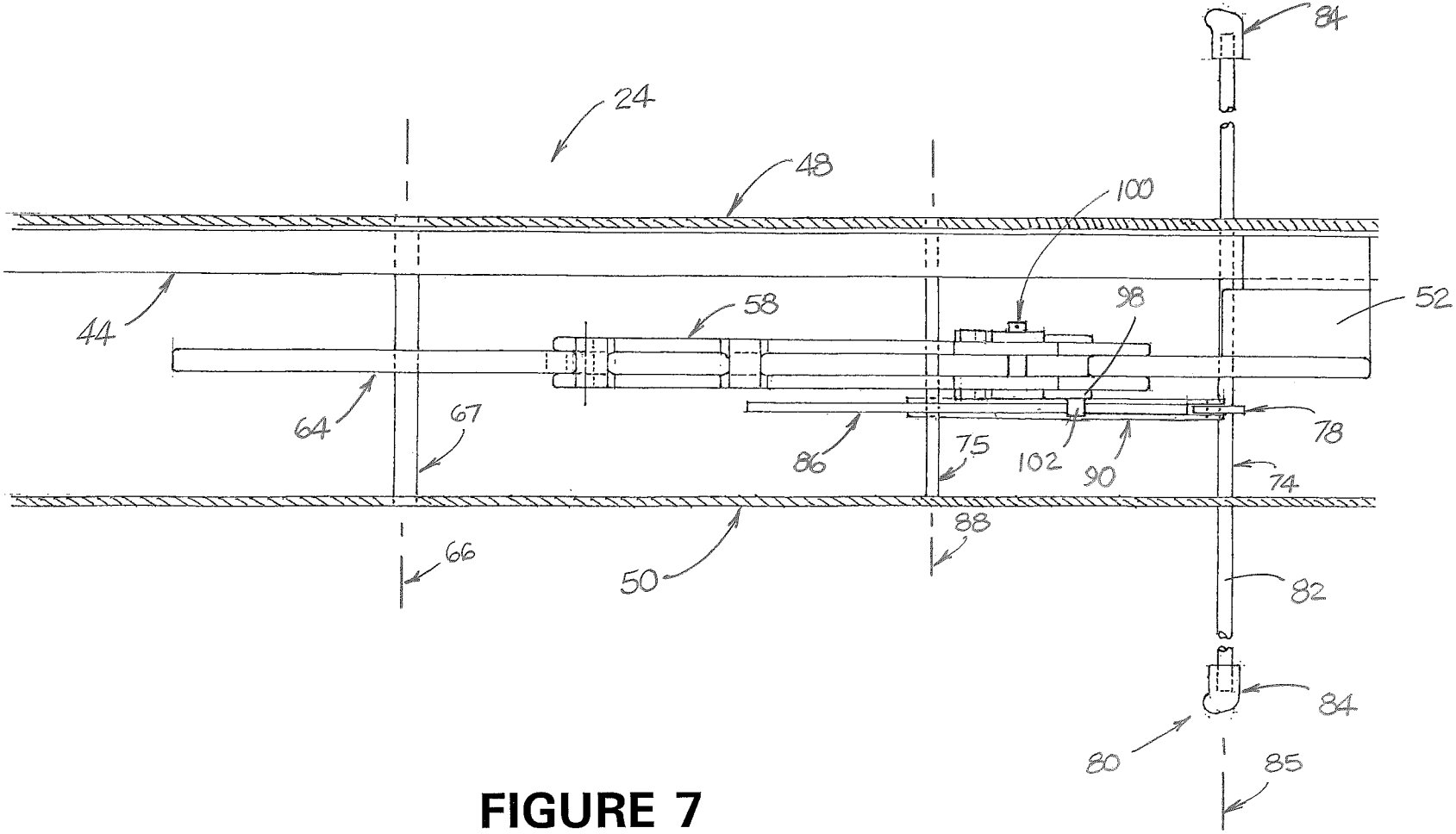
FIG. 7 is a top sectional view of the components of the door operating mechanism shown in FIG. 6, taken along line 7-7 of FIG. 6.

Center sill 24 comprises an inverted U-shaped component with downwardly depending legs 48 and 50, as shown in FIG. 7. Each door operating mechanism is mounted onto the center sill as will be explained in more detail hereinafter. Mounted for lateral movement on the center sill is operating beam 44, which is moveable back and forth along the center sill by the action of linear actuator 28. Although the operating beam will move along center sill 24 whenever linear actuator 28 is actuated, only those door operating mechanisms that are in the "armed" configuration will open or close their associated doors as a result of such movement. Door operating mechanisms that are in the disarmed configuration will not open or close their associated hopper doors with movement of the operating beam.

Each door operating mechanism includes fulcrum 52 (as shown on the right side of the drawings) that is welded or otherwise fixed to operating beam 44. The end of the fulcrum opposite the weld includes a pin 54 that is adapted to slide within slot 56 of operating arm 58. End 59 of operating arm 58 (shown on the left in the drawings) is pivotally attached at intermediate pivot mount 60 on right arm 62 of V-lever 64. The V-lever is pivotally attached at pivot 66 to left bracket 67 that is mounted on and extends across the bottom of the center sill. Left arm 68 of V-lever 64 is attached at pivot 70 to left hopper door 26L of each pair with which it is associated by means of a rod, bar or other means (not shown) known to those of ordinary skill in the art.

Similarly, right arm 62 of V-lever 64 is attached at upper pivot 72 to right hopper door 26R of each pair with which the door operating mechanism is associated.

Figure 5:
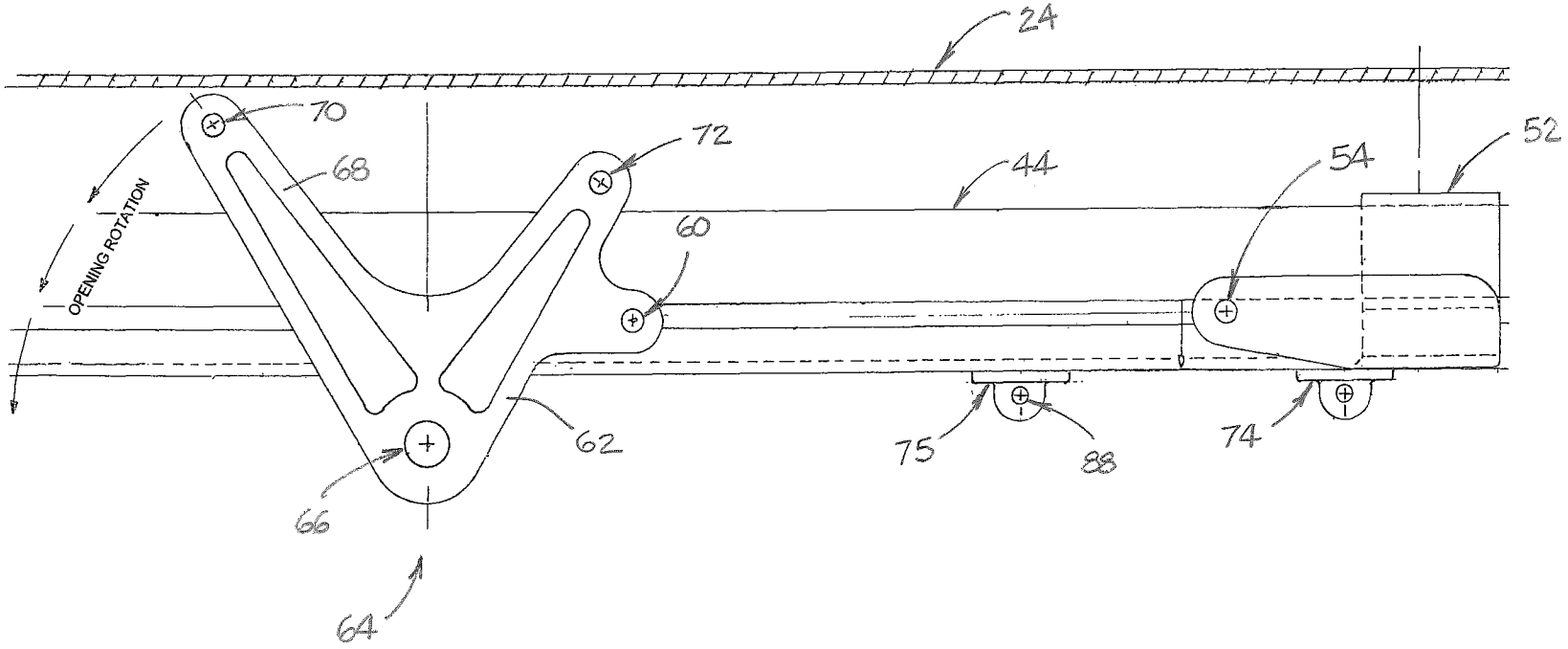
FIG. 5 is a front view of a portion of the components of the door operating mechanism of the invention.

As shown in FIGS. 5 and 7, each door operating mechanism also includes right bracket 74 and intermediate bracket 75 that are attached to and extend across the bottom of center sill 24. Actuating lever 78 is pivotally attached to right bracket 74, as is an operating handle assembly 80 comprising an operating shaft 82 and a pair of operating handles 84, one of which is located on each side of railroad hopper car 20. The operating handles 84 and the actuating lever 78 are fixed with respect to each other, so that rotation of an operating handle about axis 85 by a user will also rotate the actuating lever about the same axis and in the same direction.

Star lever 86 is pivotally attached at central pivot 88 to intermediate bracket 75. First end 89 of connecting link 90 is pivotally attached at pivot 92 to the bottom of actuating lever 78, and second end 93 of connecting link 90 is pivotally attached at pivot 94 to link arm 96 of star lever 86. Arming cam 98 is pivotally attached at pivot 100 to an upper part of operating arm 58 behind (as viewed in the drawings) star lever 86, so that the arming cam pivots in a plane that is behind the plane of the star lever, as viewed in FIG. 7. However, arming cam 98 includes cam projection 101 terminating in cam pin 102 that extends outwardly (i.e., out past the plane of star lever 86 as shown in FIG. 7) so as to be engaged by first upper surface 103 of first camming arm 104 of star lever 86, or alternatively by second upper surface 105 of second camming arm 106, as explained in more detail hereinafter. Also fixed to operating arm 58 is CW stop lug 107 that that limits the motion of arming cam 98 in a clockwise direction (as shown in FIG. 6) and CCW stop lug 108 that limits the motion of the arming cam in a counter-clockwise direction.

Actuating lever 78, operating handle assembly 80, star lever 86, connecting link 90, arming cam 98, CW stop lug 107 and CCW stop lug 108 comprise an arming assembly that is configurable in an armed configuration in which longitudinal movement of the operating beam will cause the left hopper door and the right hopper door to move between opened and closed positions, and in a disarmed configuration in which longitudinal movement of the operating beam will not cause the left hopper door and the right hopper door to move.

Figure 6:
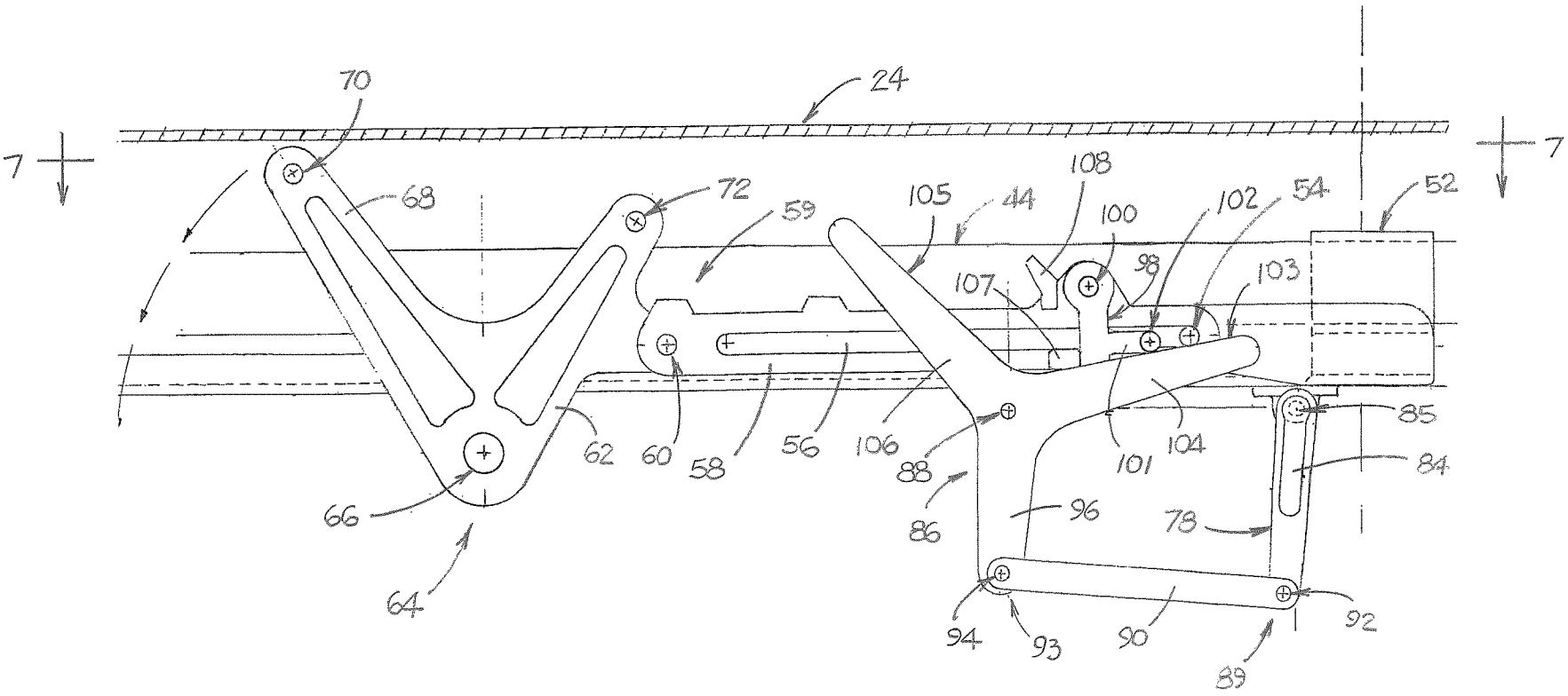
FIG. 6 is a front view of the components of the door operating mechanism of the invention, showing the arming cam of the door operating mechanism in the "armed" position.
Figure 8:
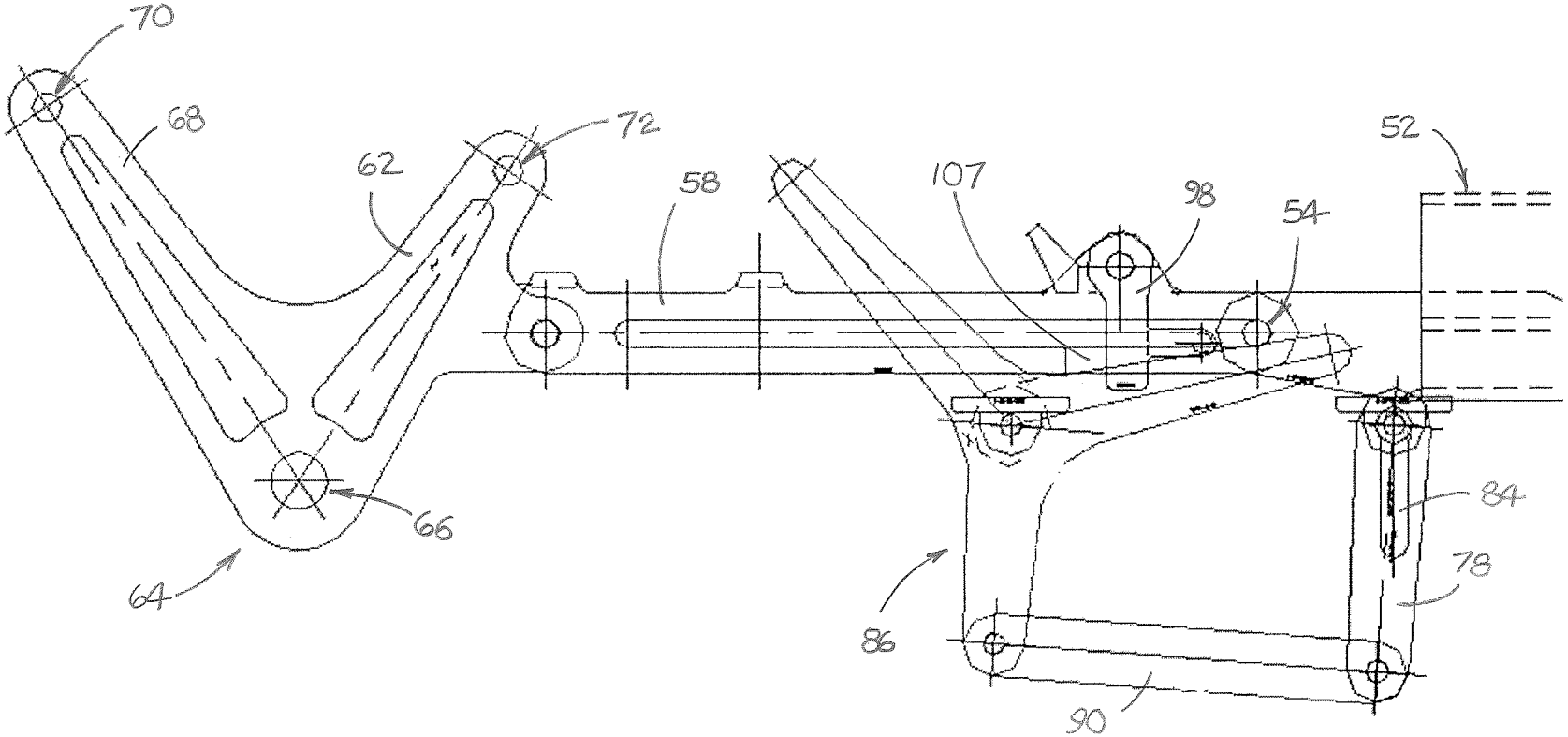
FIG. 8 is a schematic view of the components of the door operating mechanism of the invention, showing the arming cam of the door operating mechanism in the "armed" position.
Figure 9:
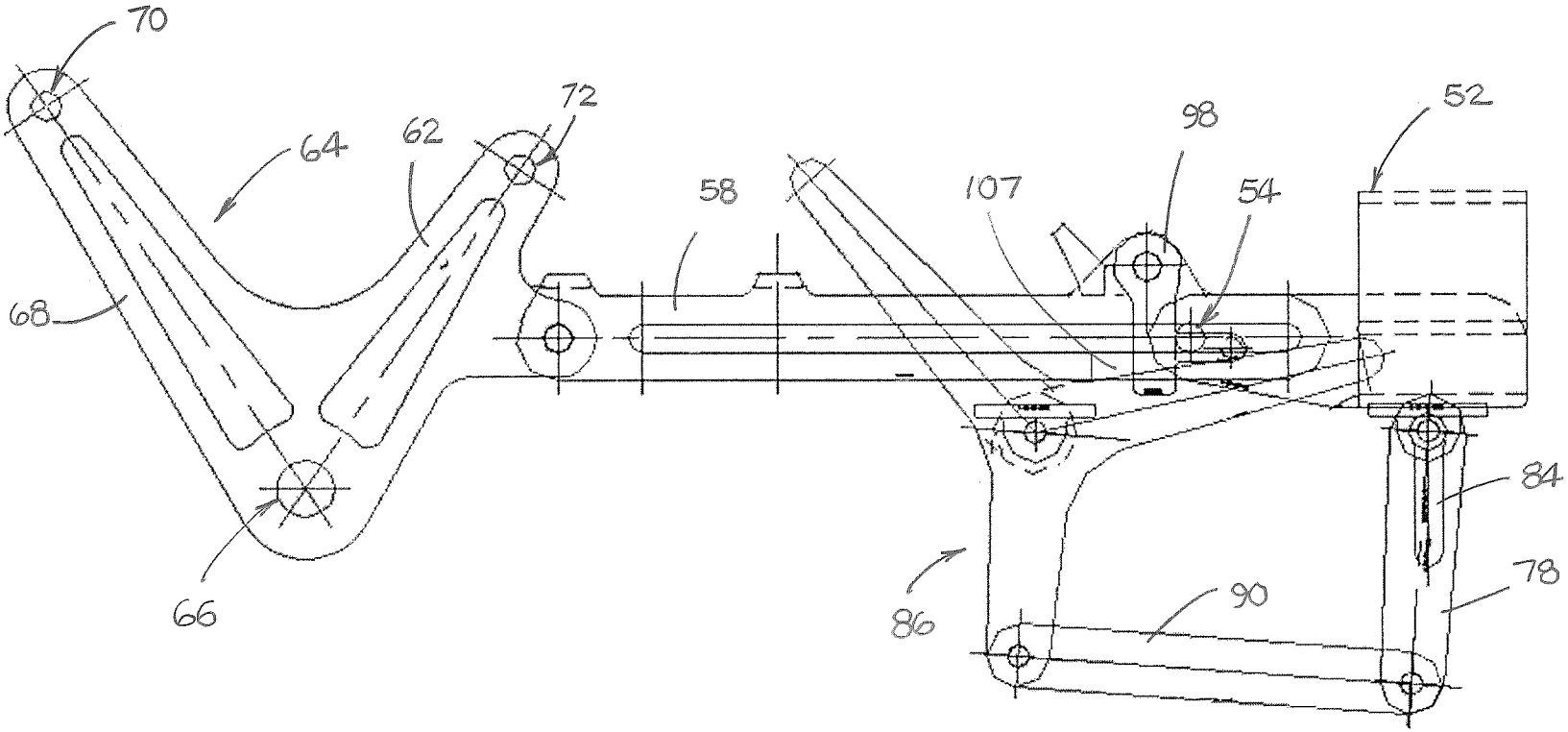
FIG. 9 is a schematic view of the components of the door operating mechanism of the invention, showing the arming cam of the door operating mechanism in the "armed" position with the linear actuator applying a linear force to move the operating beam to a first position in the door opening sequence.
Figure 10:
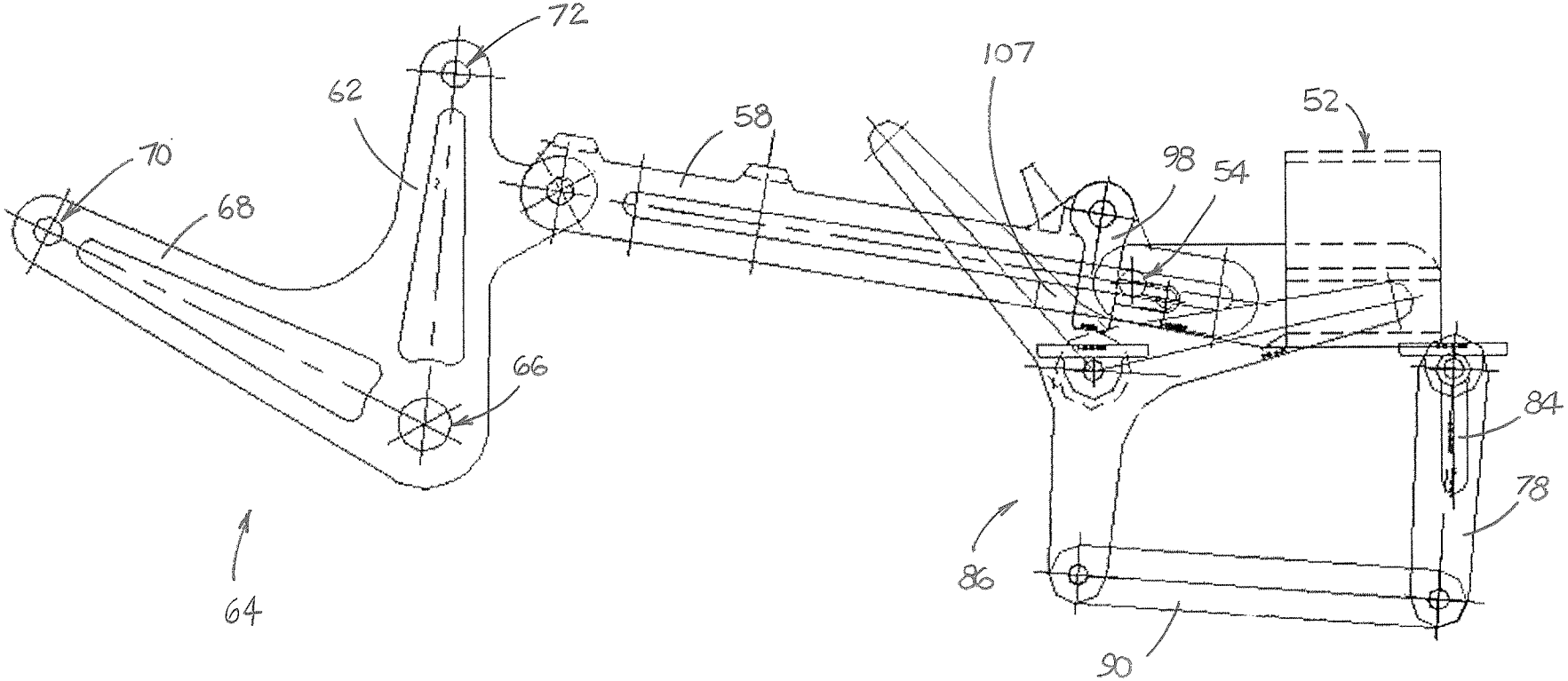
FIG. 10 is a schematic view of the components of the door operating mechanism of the invention, showing the arming cam of the door operating mechanism in the "armed" position with the linear actuator applying a linear force to move the operating beam to a second position in the door opening sequence.
Figure 11:
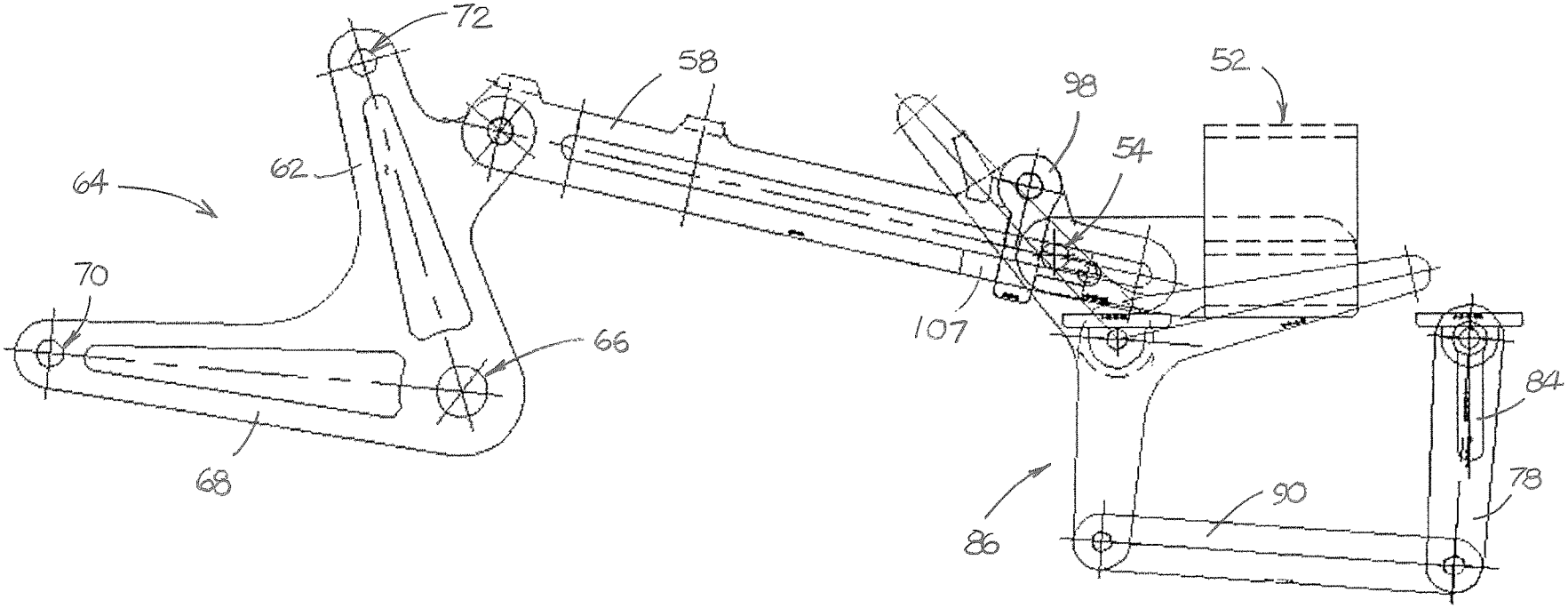
FIG. 11 is a schematic view of the components of the door operating mechanism of the invention, showing the arming cam of the door operating mechanism in the "armed" position with the linear actuator applying a linear force to move the operating beam to a third position in the door opening sequence.
Figure 12:
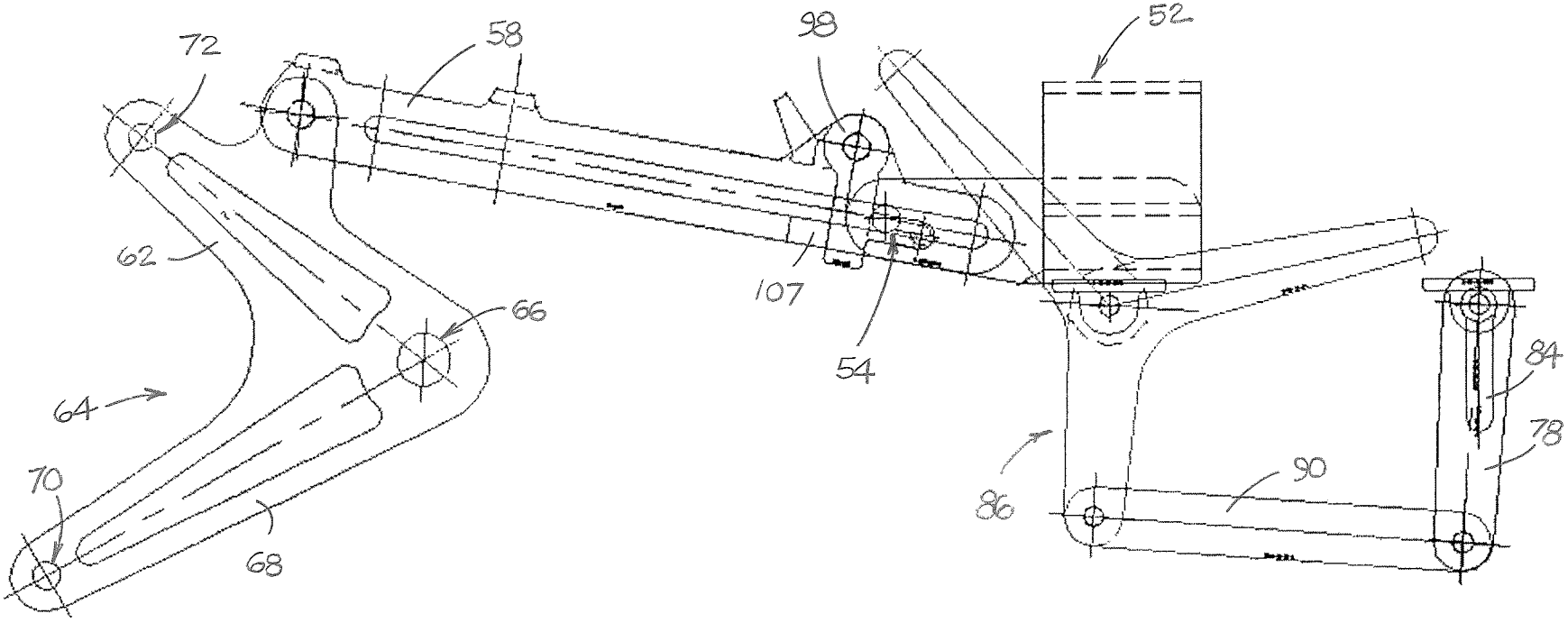
FIG. 12 is a schematic view of the components of the door operating mechanism of the invention, showing the arming cam of the door operating mechanism in the "armed" position with the linear actuator applying a linear force to the move the operating beam to a fourth position in the door opening sequence.
Figure 13:
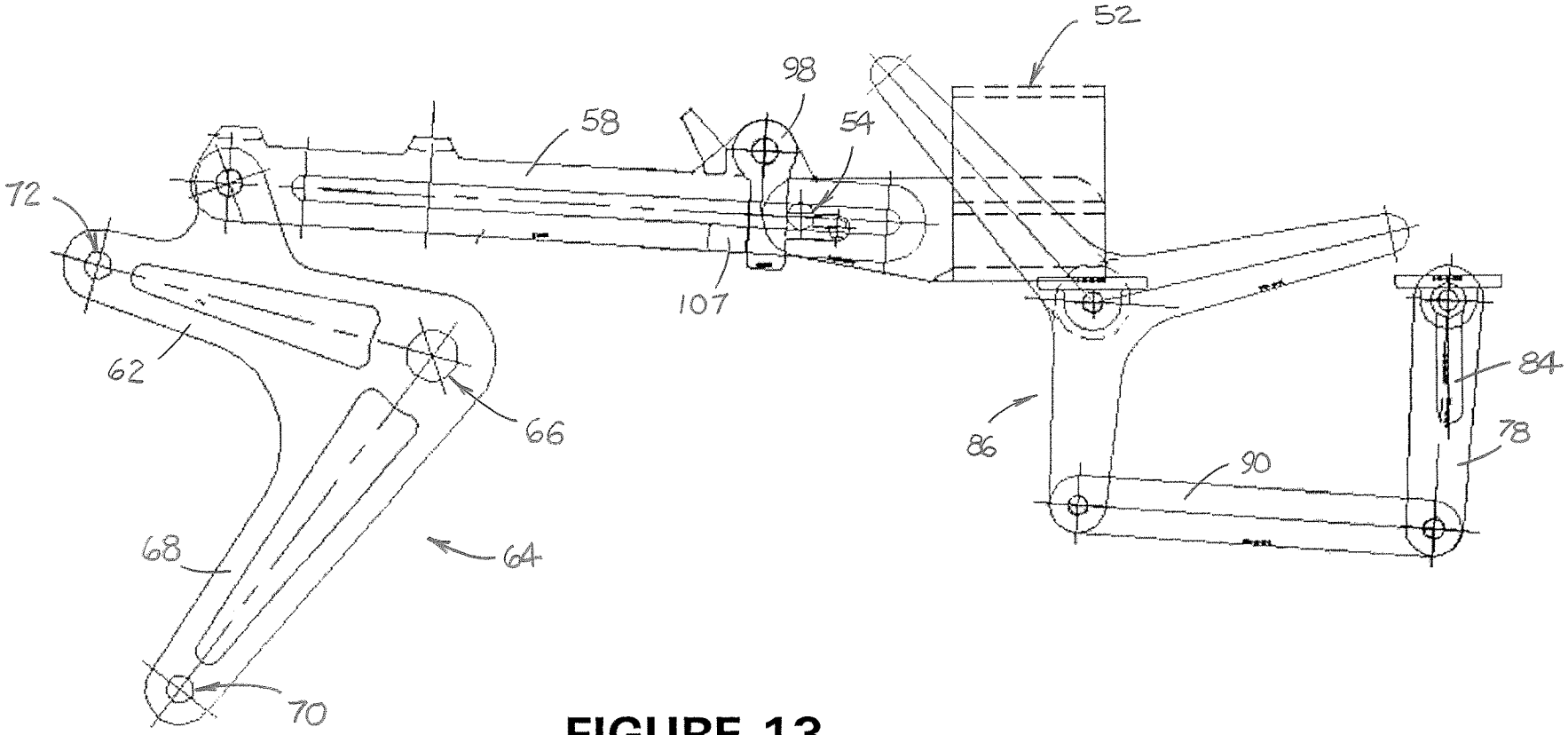
FIG. 13 is a schematic view of the components of the door operating mechanism of the invention, showing the arming cam of the door operating mechanism in the "armed" position with the linear actuator applying a linear force to move the operating beam to a final position in the door opening sequence.

FIGS. 8-13 illustrate the sequence of operation of a door operating mechanism after the arming cam has been rotated to the "armed" position that is illustrated in FIG. 6. As shown in these drawings, operating handle 84 of operating handle assembly 80 has been rotated in a clockwise direction to move arming cam 98 into engagement with CW stop lug 107, as shown in FIGS. 6 and 8. This action "arms" a door operating mechanism with respect to the hopper doors 26L and 26R with which it is associated. When the door operating mechanism has thus been "armed", linear actuator 28 may be operated to cause operating beam 44 to move to the left as shown in FIGS. 9-13. This causes fulcrum 52 to push pin 54 to the left within slot 56 of operating arm 58 and behind cam projection 101 to contact the side of arming cam 98, as shown in FIG. 9. As linear actuator 28 continues to move operating beam 44 to the left, as shown in FIGS. 10-13, the movement of the operating beam will rotate V-lever 64 counter-clockwise about pivot 66. Since left arm 68 of V-lever 64 is attached at pivot 70 to a left hopper door 26L and right arm 62 of V-lever 64 is attached at upper pivot 72 to a corresponding right hopper door 26R with which the door operating mechanism is associated, the rotation of V-lever 64 from the position shown in FIG. 9 through the positions shown in FIGS. 10-12 to that shown in FIG. 13 will cause the left and right doors to move from the closed positions shown in FIG. 1 to the open positions shown in FIG. 2.

If linear actuator is operated to move operating beam 44 to the right as shown in the drawings, with arming cam 98 in the "armed" position abutting CW stop lug 107, the movement of the components of the door operating mechanism shown in FIGS. 9-13 will reverse (i.e., from the position shown in FIG. 13 through the positions shown in FIGS. 12, 11 and 10 to the position shown in FIG. 9) to move doors 26L and 26R from the open positions shown in FIG. 2 to the closed positions shown in FIG. 1.

Figure 14:
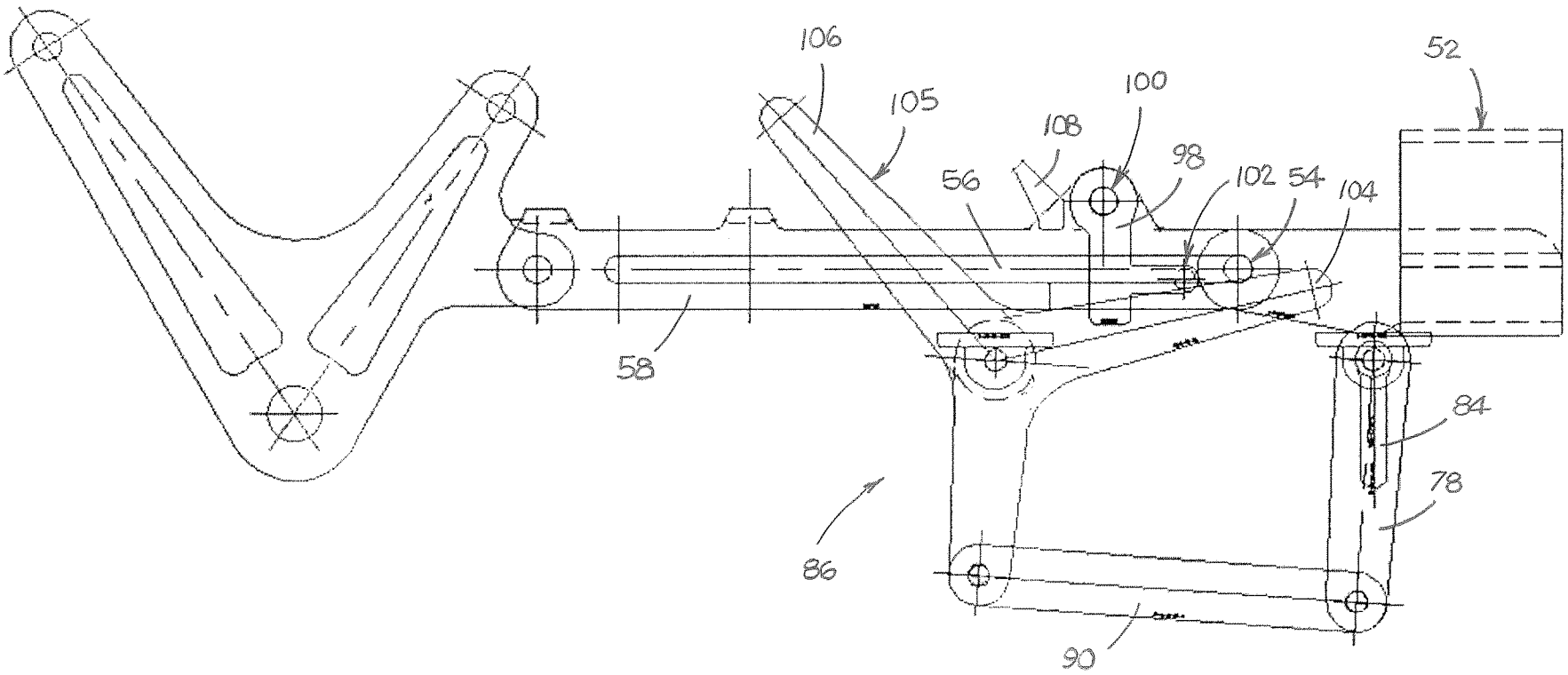
FIG. 14 is a schematic view of the components of the door operating mechanism of the invention, showing the arming cam of the door operating mechanism being rotated to a first position towards the "disarmed" position.
Figure 15:
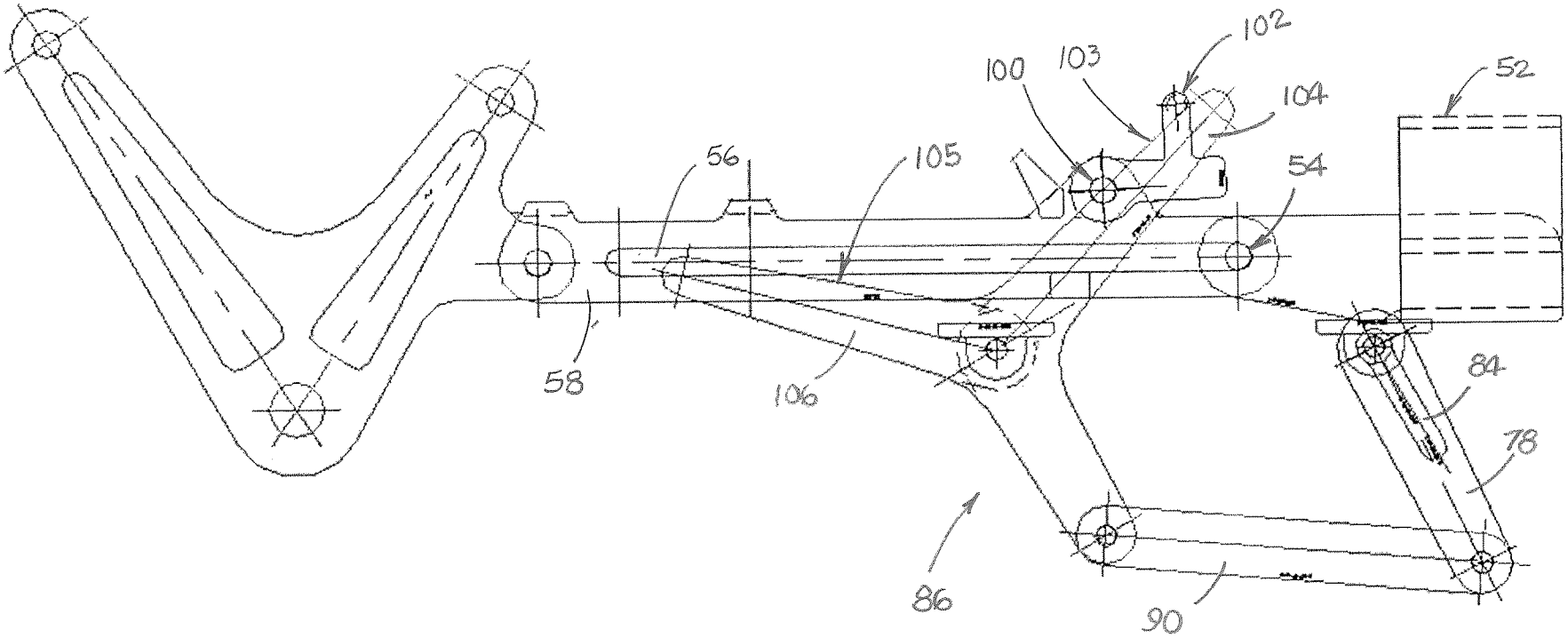
FIG. 15 is a schematic view of the components of the door operating mechanism of the invention, showing the arming cam of the door operating mechanism being rotated to a second position towards the "disarmed" position.
Figure 16:
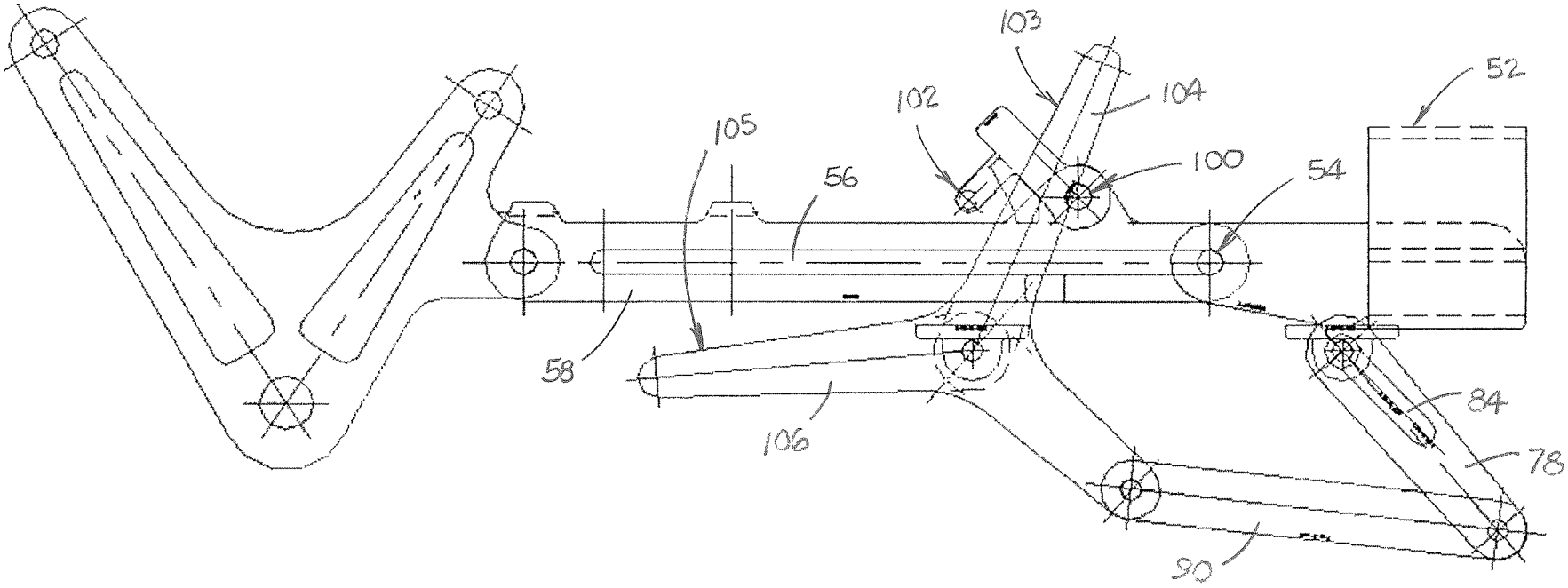
FIG. 16 is a schematic view of the components of the door operating mechanism of the invention, showing the arming cam of the door operating mechanism in the "disarmed" position.

FIGS. 14-16 illustrate the sequence of rotating the arming cam in a counter-clockwise direction from the "armed" position shown in FIG. 14 to the "disarmed" position shown in FIG. 16. Thus, as shown therein, operating handle 84 of operating handle assembly 80 is rotated in a counter-clockwise direction to cause connecting link 90 to move to the right, as shown in these drawings, thereby causing star lever 86 to pivot about pivot 88 in a counter-clockwise direction.

This movement of the star lever will cause first upper surface 103 of first camming arm 104 of star lever 86 to engage cam pin 102 of arming cam 98, thereby causing the arming cam to rotate in a counter-clockwise direction about pivot 100 until it engages CCW stop lug 108.

When the door operating mechanism is in the "disarmed" configuration shown in FIG. 16, rotation of operating handle 84 of operating handle assembly 80 in a clockwise direction will return the arming cam to the "armed" position shown in FIGS. 6 and 8. This is accomplished because the rotation of operating handle 84 in a clockwise direction from the "disarmed" configuration shown in FIG. 16 will cause connecting link 90 to move to the left, thereby causing star lever 86 to pivot about pivot 88 in a clockwise direction until second upper surface 105 of second camming arm 106 engages cam pin 102 of cam projection 101 of arming cam 98. Further rotation of the star lever will cause the second upper surface of second camming arm 106 to push cam pin 102 until the arming cam has rotated in a clockwise direction about pivot 100 to engage CW stop lug 107.

Figure 17:
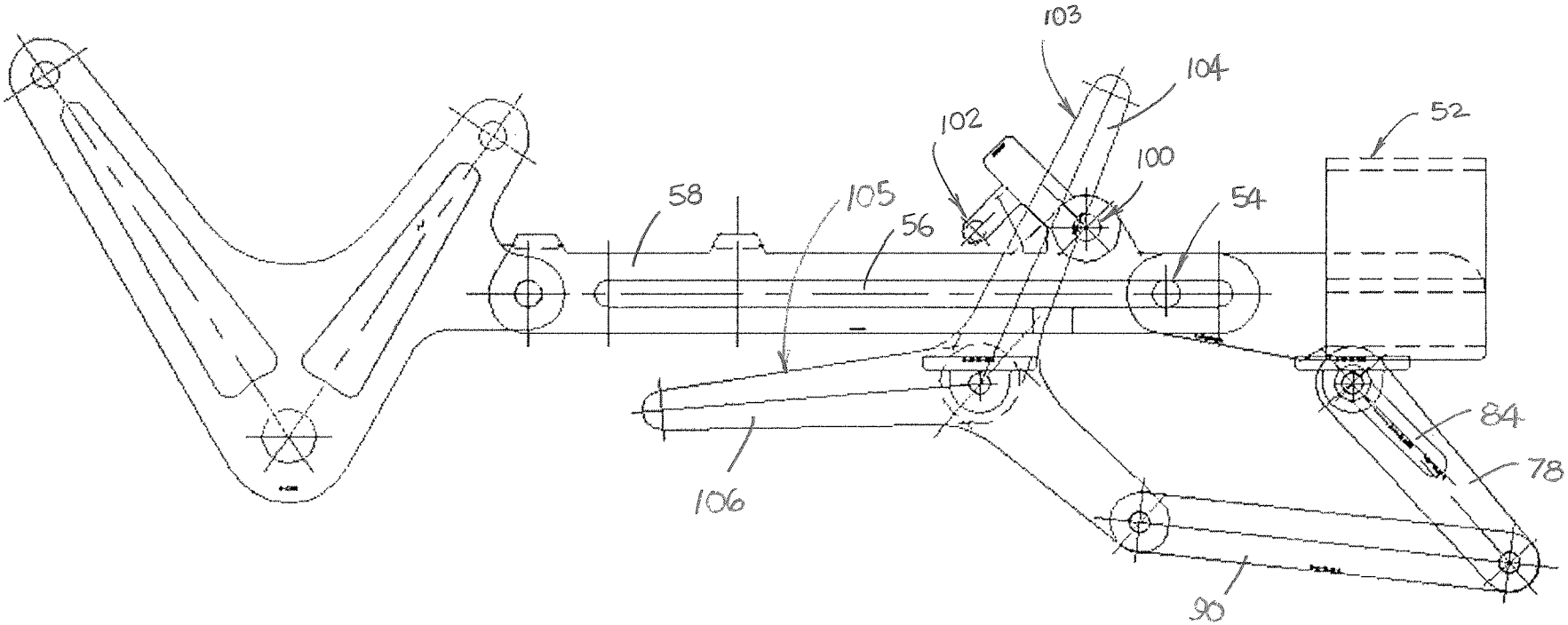
FIG. 17 is a schematic view of the components of the door operating mechanism of the invention, showing the arming cam of the door operating mechanism in the "disarmed" position with the linear actuator applying a linear force to move the operating beam to a first position in the sequence.
Figure 18:
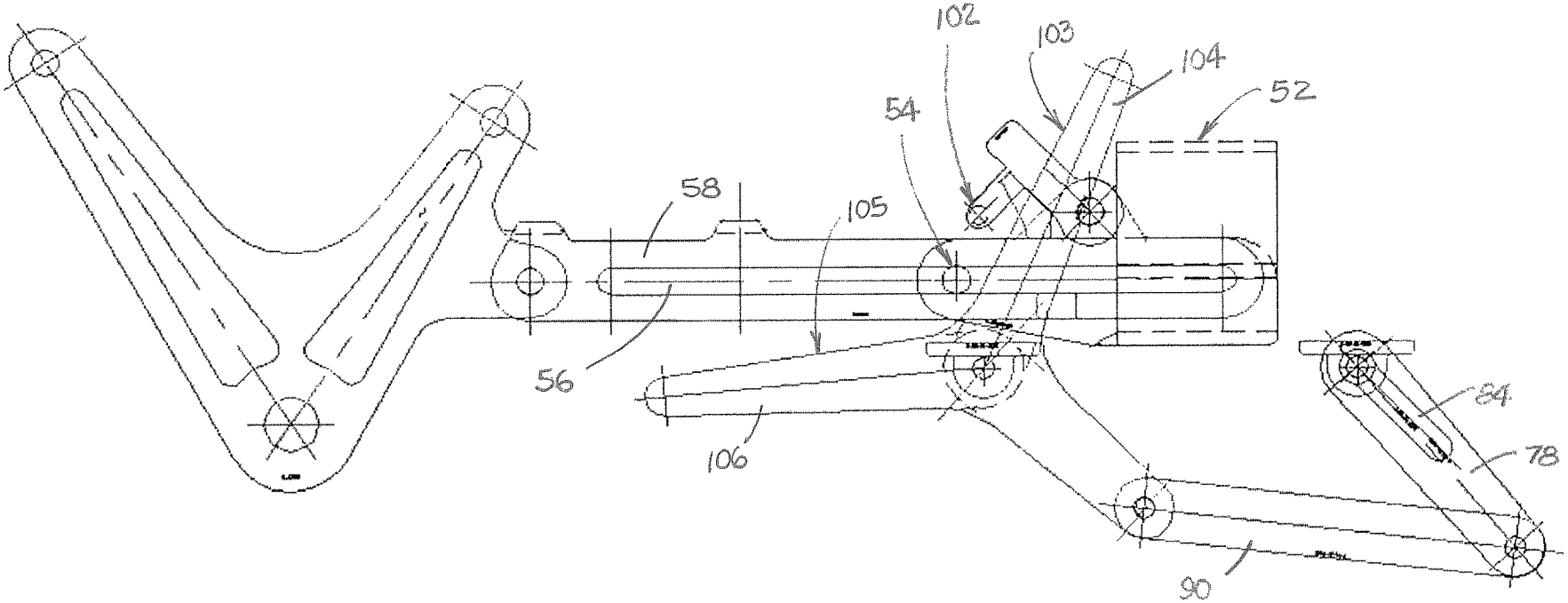
FIG. 18 is a schematic view of the components of the door operating mechanism of the invention, showing the arming cam of the door operating mechanism is the "disarmed" position with the linear actuator applying a linear force to the move the operating beam to a second position in the sequence.
Figure 19:
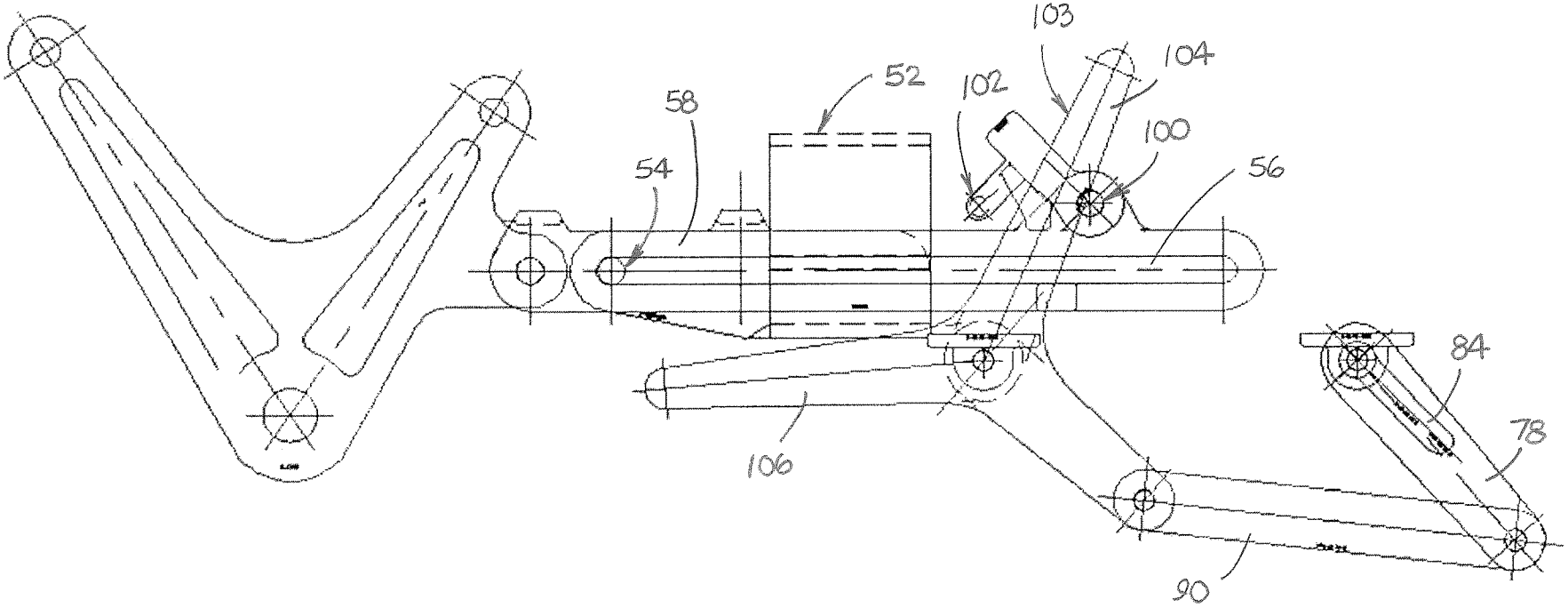
FIG. 19 is a schematic view of the components of the door operating mechanism of the invention, showing the arming cam of the door operating mechanism is the "disarmed" position with the linear actuator applying a linear force to move the operating beam to a final position in the sequence.

However, when the door operating mechanism is in the "disarmed" configuration shown in FIG. 16, linear actuator 28 may be operated to cause operating beam 44 to move to the left as shown in FIGS. 17-19. This causes pin 54 of fulcrum 52 to move to the left (as shown in the drawings) within slot 56 of operating arm 54, since arming cam 98 has been rotated out of the way. Thus, as shown in FIGS. 17-19, the lateral movement of operating beam 44 to which fulcrum 52 is attached is translated into motion along slot 56 of operating arm 54, which motion does not rotate V-lever 64 about pivot 66. Thus, the doors associated with the door operating mechanism in the "disarmed" configuration do not move with operation of linear actuator 28. If linear actuator is operated to move operating beam 44 to the right as shown in the drawings, with arming cam 98 in the "disarmed" position abutting CCW stop lug 108, the movement of the components of the door operating mechanism shown in FIGS. 16-19 will reverse (i.e., from the position shown in FIG. 19 through the positions shown in FIGS. 18 and 17 to the position shown in FIG. 16) without moving doors 26L and 26R.

The invention thus provides a door operating mechanism that may be associated with each of the transversely oriented pairs of hopper doors of a railroad hopper car. Each such door operating mechanism can be armed or disarmed independently of each other door operating mechanism so that a single linear actuator can be operated to selectively open or close one or any number of the transversely oriented hopper door pairs on the railroad hopper car.

Although this description contains many specifics, these should not be construed as limiting the scope of the invention but as merely providing illustrations of the presently preferred embodiments thereof, as well as the best mode contemplated by the inventors of carrying out the invention. The invention, as described and claimed herein, is susceptible to various modifications and adaptations, as would be understood by those having ordinary skill in the art to which the invention relates.

What is claimed is:

1. A door operating mechanism for operating a left hopper door and a right hopper door associated with a hopper of a railroad hopper car, said railroad hopper car including an operating beam that is longitudinally moveable within a center sill, said door operating mechanism comprising:

(a) an operating arm that includes a longitudinal slot;

(b) a fulcrum that is attached to the operating beam and includes a pin that is adapted to slide within the slot of the operating arm;

(c) a V-lever that is pivotally mounted on the center sill, said V-lever comprising:

(i) a left arm that is attached to the left hopper door;

(ii) a right arm that is attached to the right hopper door, said right arm including an intermediate pivot mount to which the operating arm is pivotally attached;

(d) an arming assembly that is configurable in:

(i) an armed configuration in which longitudinal movement of the operating beam will cause the left hopper door and the right hopper door to move between opened and closed positions; and (ii) a disarmed configuration in which longitudinal movement of the operating beam will not cause the left hopper door and the right hopper door to move.

2. The door operating mechanism of claim 1 wherein when the arming assembly is in the armed configuration, movement of the operating beam will move the operating arm to pivot the V-lever about its pivot on the center sill.

3. The door operating mechanism of claim 1 wherein when the arming assembly is in the disarmed configuration, movement of the operating beam causes the pin of the fulcrum to move along the slot of the operating arm without rotating the V-lever about its pivot on the center sill.

4. The door operating mechanism of claim 1 wherein the arming assembly includes an arming cam that is pivotally mounted to an upper part of the operating arm and adapted to pivot between:

(a) an armed position in which longitudinal movement of the operating beam will cause the left hopper door and the right hopper door to move between opened and closed positions; and (b) a disarmed position in which longitudinal movement of the operating beam will not cause the left hopper door and the right hopper door to move.

5. The door operating mechanism of claim 4 wherein the arming assembly includes:

(a) a CW stop lug that is fixed to the operating arm and adapted to limit the motion of the arming cam in a clockwise direction;

(b) a CCW stop lug that is fixed to the operating arm and adapted to limit the motion of the arming cam in a counter-clockwise direction.

6. The door operating mechanism of claim 5 wherein:

(a) the arming assembly is configured in the armed configuration when the arming cam is pivoted into contact with the CW stop lug;

(b) the arming assembly is configured in the disarmed configuration when the arming cam is pivoted into contact with the CCW stop lug.

7. The door operating mechanism of claim 4 wherein the arming assembly comprises:

(a) an actuating lever that is pivotally attached to the center sill;

(b) an operating shaft to which an operating handle is attached, said operating handle being fixed with respect to the actuating lever so that rotation of the operating handle will also rotate the actuating lever in the same direction.

8. The door operating mechanism of claim 7 wherein the arming assembly comprises:

(a) a star lever that is pivotally attached to the center sill, said star lever having a link arm;

(b) a connecting link having a first end that is pivotally attached to the actuating lever and a second end that is pivotally attached to the link arm of the star lever.

9. The door operating mechanism of claim 8 wherein:

(a) the star lever comprises a first camming arm having a first upper surface and a second camming arm having a second upper surface;

(b) the arming cam is adapted to pivot in a plane that is behind the plane of the star lever, said arming cam including a cam projection terminating in a cam pin that extends outwardly:

(i) so as to be engaged by the first upper surface of first camming arm of the star lever when the arming cam is in the armed position and the actuating lever is pivoted in a counter-clockwise direction;

(ii) so as to be engaged by the second upper surface of the second camming arm of the star lever when the arming cam is in the disarmed position and the actuating lever is pivoted in a clockwise direction.

* * * * *